US007735844B2

(12) United States Patent
Gallo

(10) Patent No.: US 7,735,844 B2
(45) Date of Patent: Jun. 15, 2010

(54) LAMINATED SKATEBOARD

(76) Inventor: Geoffrey Gallo, 6637 W. Hyde Ave., Las Vegas, NV (US) 89107

( * ) Notice: Subject to any disclaimer, the term of this patent is extended or adjusted under 35 U.S.C. 154(b) by 1223 days.

(21) Appl. No.: 10/805,524

(22) Filed: Mar. 19, 2004

(65) Prior Publication Data

US 2004/0188967 A1 Sep. 30, 2004

Related U.S. Application Data

(60) Provisional application No. 60/456,658, filed on Mar. 24, 2003.

(51) Int. Cl.
*B62M 1/00* (2010.01)

(52) U.S. Cl. ..... 280/87.042; 280/607; 280/610

(58) Field of Classification Search ..... 280/87.041, 280/87.042, 609, 610, 14.22, 611, 601, 607, 280/603, 608, 87.01
See application file for complete search history.

(56) References Cited

U.S. PATENT DOCUMENTS 3,173,161 A * 3/1965 Amsbry ..... 280/609
3,707,296 A * 12/1972 Palazzolo et al. ..... 280/610
4,295,656 A * 10/1981 Moore ..... 280/87.042
4,412,687 A * 11/1983 Andre ..... 280/610
4,697,821 A * 10/1987 Hayashi et al. ..... 280/609
5,005,853 A * 4/1991 Lampl ..... 280/610
5,238,260 A * 8/1993 Scherubl ..... 280/610
5,320,378 A * 6/1994 Wiig ..... 280/610
6,059,307 A * 5/2000 Western ..... 280/609
6,182,986 B1 * 2/2001 Smith ..... 280/87.042
6,527,284 B2 * 3/2003 Bert ..... 280/87.041

* cited by examiner

*Primary Examiner*—Hau V Phan
(74) *Attorney, Agent, or Firm*—Jon Fallon, Esq

(57) ABSTRACT

A method of manufacturing a reinforced skateboard deck during the skateboard deck manufacturing process with adhering non-wood materials to the laminate ply's of wood with non-wood materials and the steps of adhering the non-wood material to the wood ply laminate for installation on the top wood laminate and or between any of the laminated layers of the skateboard deck during the normal laminating process and a method of manufacturing a skateboard deck during the skateboard deck manufacturing process with the installation and adhering of a strip or strip's of non-wood metallic material to a laminate ply of wood with the method comprising of the steps of adhering the non-wood metallic material to the wood ply laminate creating a center core cartridge with the non-wood metallic material installed for the installation during the normal skateboard deck laminating process.

12 Claims, 8 Drawing Sheets

CROSS SECTION OF SIDE VIEW ( FIGURE 1 )
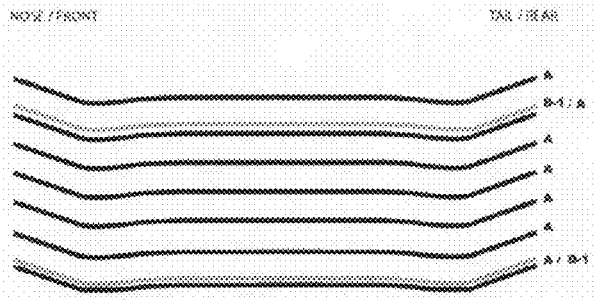
CROSS SECTION OF SIDE VIEW
( FIGURE 2)
A Wood Layer
B-1 Non-Wood Material
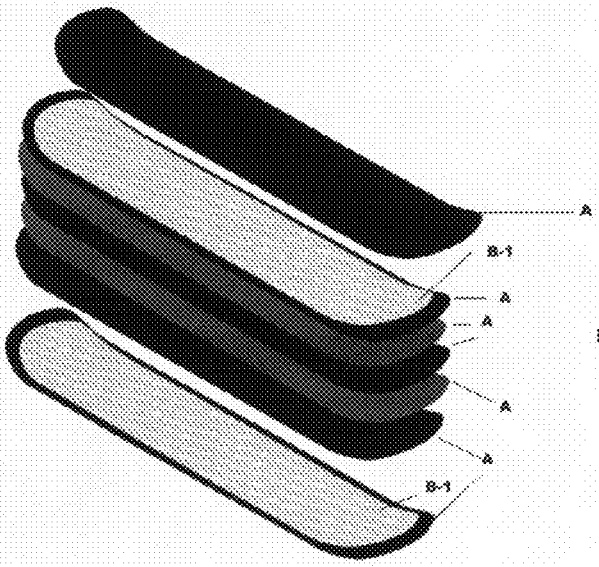
FULL VIEW OF SKATEBOARD AND LAYERS
( FIGURE 3 )
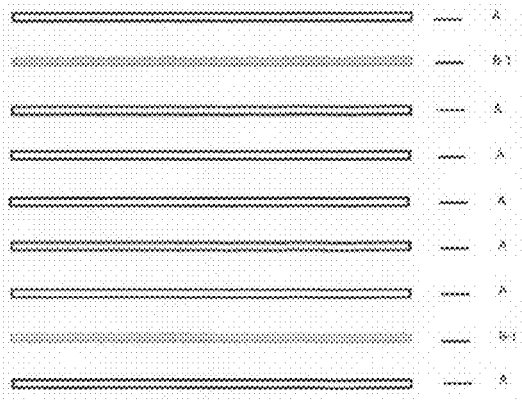
CROSS SECTION LOOKING DOWN THE LONG AXIS ( FIGURE 4 )
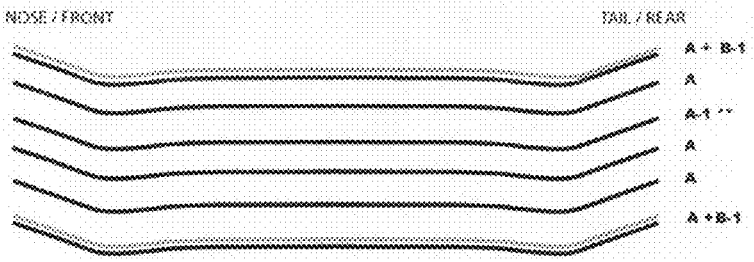
CROSS SECTION OF SIDE VIEW
( FIGURE 5 )
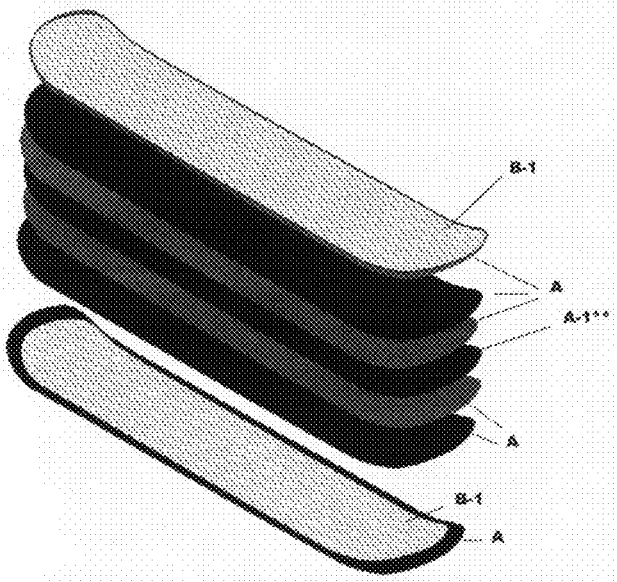
A Wood Layer
B-1 Non Wood Material
A-1 ** Titanium Strip (s) Placement Layer. See Figure's T-1 thru T-10 for Titanium Placement Options
FULL VIEW OF SKATEBOARD LAYERS
( FIGURE 6 )
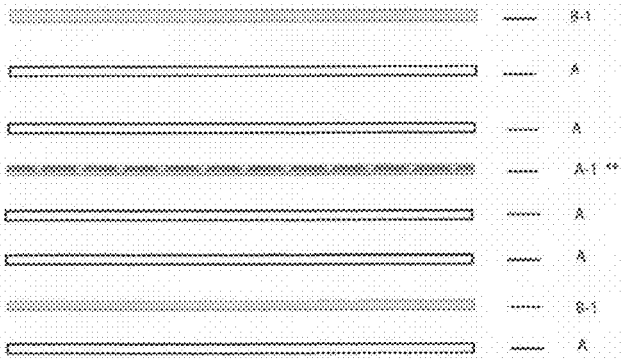
CROSS SECTION LOOKING DOWN LONG AXIS ( FIGURE 7 )
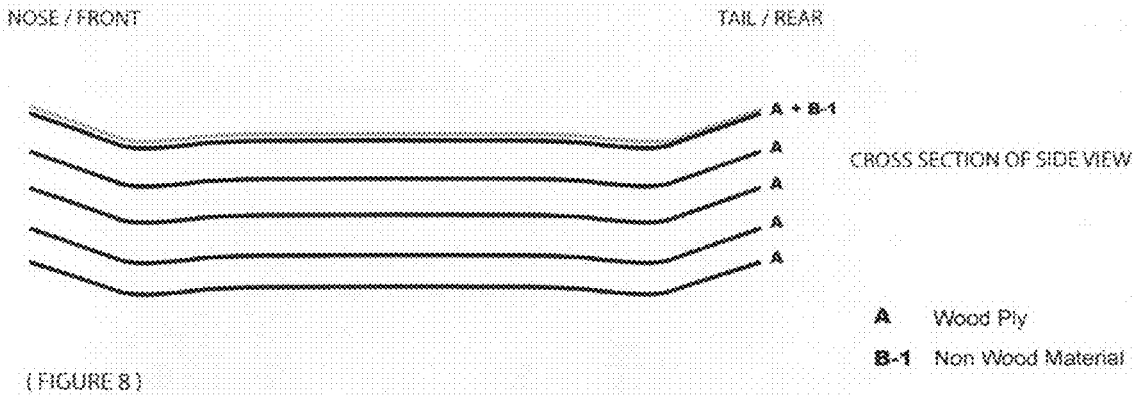
( FIGURE 8 )
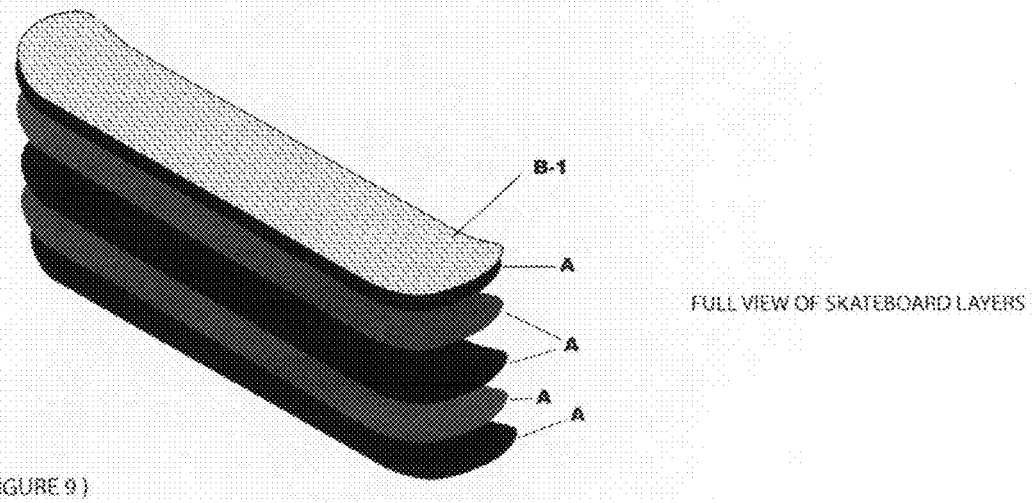
( FIGURE 9 )
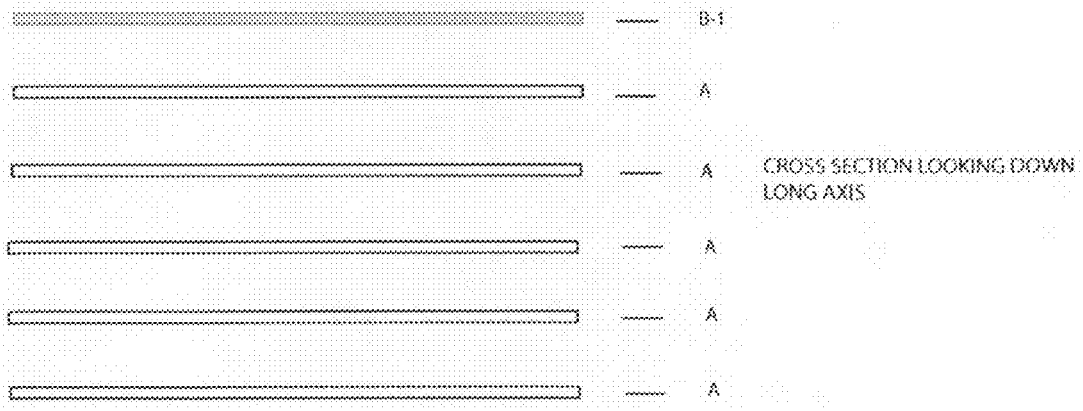

TOP VIEW OF CENTER LAYER SHOWING TITANIUM STRIP PLACEMENT IN COMBINATION WITH ANY OF THE SKATEBOARD DECK DESIGN'S

| | |
|---|---|
| DL | Skateboard Deck Wood Ply |
| B | Bolt Hole For Truck Mounting |
| T | Titainum Strip, Thickness approx 0.020" - 0.028" Greater than or less than. |
| ** | Exact Placement Of Truck Bolt Holes is determined on the wheel base of each deck. |
| *** | Length of titanium strip to be determined by overall length of deck wheel base. |
| **** | Width of titanium strip to be determined by by width and size of truck bolt hole |

( FIGURE T-1 )

NOSE / FRONT

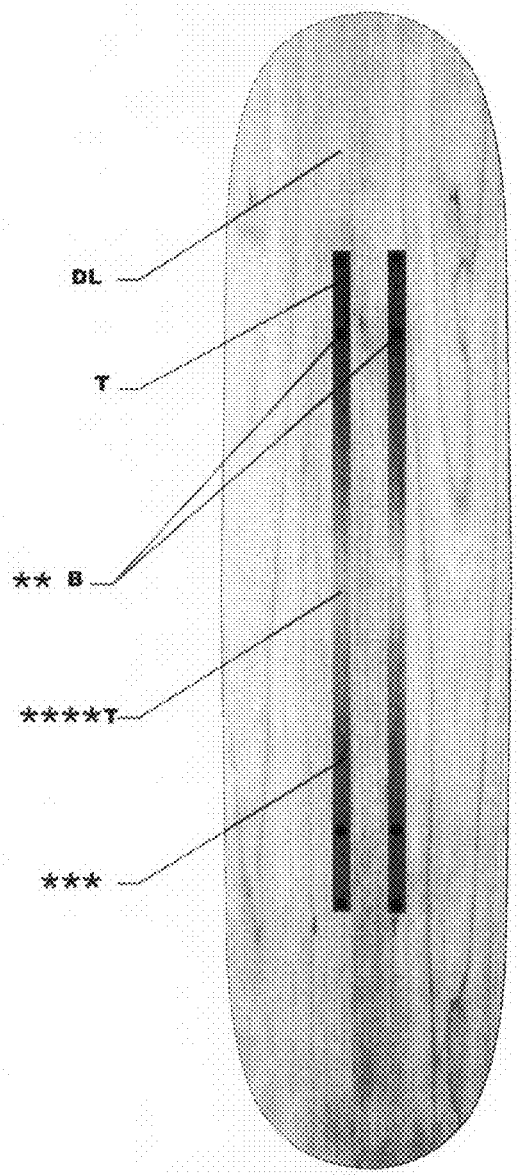

TAIL / REAR ( FIGURE T-2 )

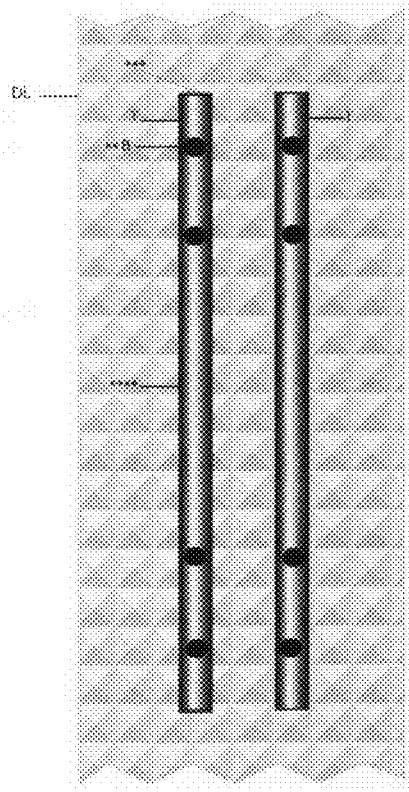

TOP VIEW OF CENTER LAYER SHOWING TITANIUM STRIP PLACEMENT IN COMBINATION WITH ANY SKATEBOARD DECK DESIGN.

DL Skateboard Deck Wood Ply

B Bolt Hole For Truck Mounting only pointing to two of the eight bolt holes.

T Titainum Strip. Thickness approx 0.020" - 0.028" Greater than or less than.

**** Exact Placement Of Truck Bolt Holes is determined on the wheel base of each deck.

***** Length of titanium strip to be determined by overall length of the wheel base of the deck.

****** Width of titanium strip to be determined by by size/width of truck bolt hole.

( FIGURE T-3 )

NOSE / FRONT

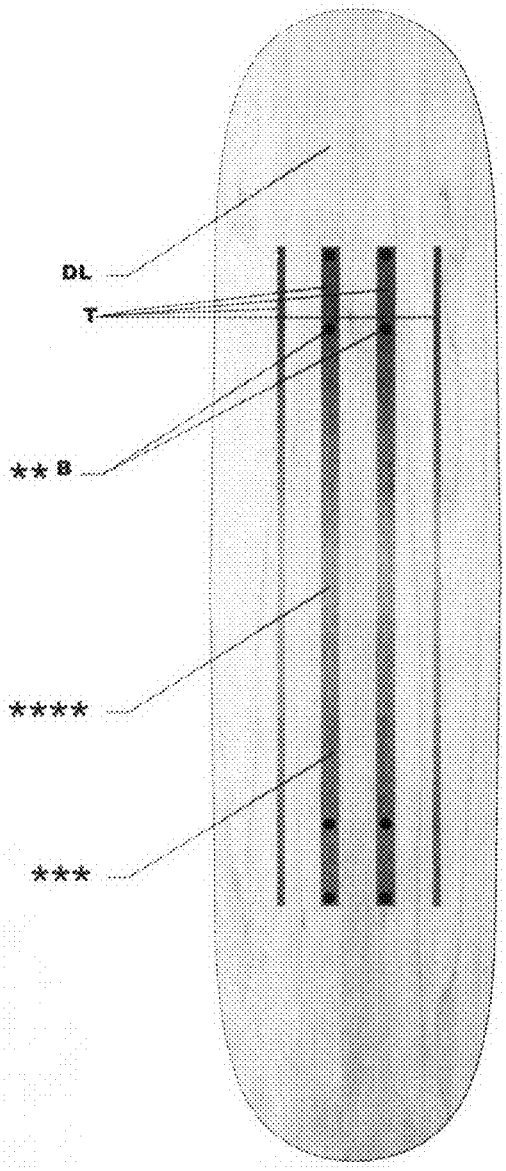

TAIL / REAR ( FIGURE T-4 )

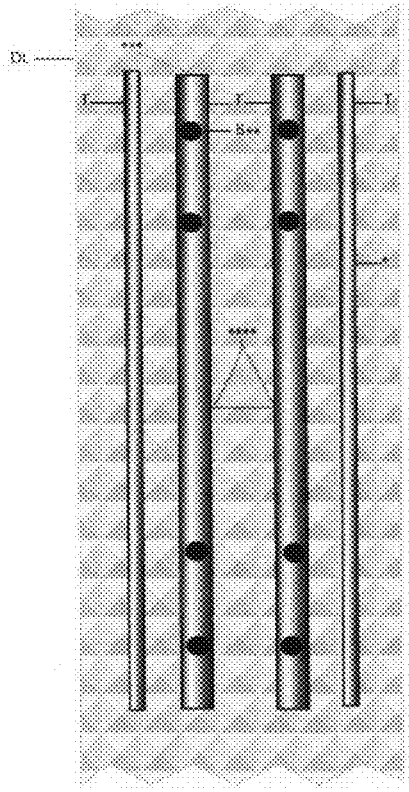

TOP VIEW OF CENTER LAYER SHOWING TITANIUM STRIP PLACEMENT IN COMBINATION WITH ANY SKATEBOARD DECK DESIGN.

DL Skateboard Deck Wood Ply Layer

B Bolt Hole For Truck Mounting

T Titainum Strip, Thickness approx 0.020" - 0.028" Greater than or less than.

** Exact Placement Of Truck Bolt Holes is determined on the wheel base of each deck, only one bolt is pointed to.

*** Length of titanium strip to be determined by overall length of deck wheel base.

**** Width of titanium strip to be determined by by width of truck bolt holes.

( FIGURE T-5)

NOSE / FRONT

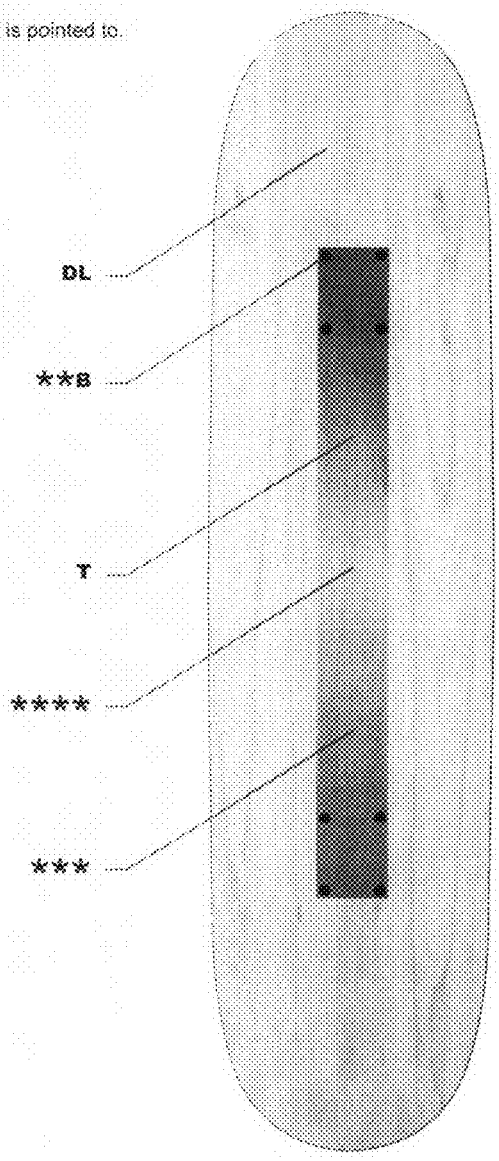

TAIL / REAR ( FIGURE T-6 )

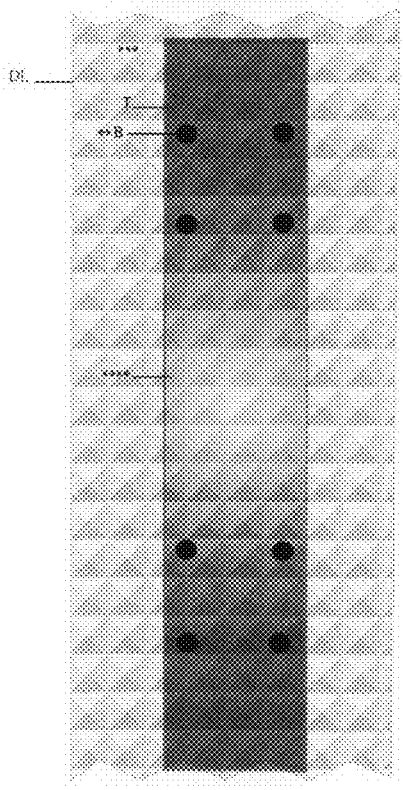

TOP VIEW OF CENTER LAYER SHOWING TITANIUM STRIP PLACEMENT IN COMBINATION WITH ANY SKATEBOARD DECK DESIGN

DL Skateboard Deck Wood Ply Layer

B Bolt Hole For Truck Mounting

T Titainum Strip, Thickness approx 0.020" ~ 0.028" Greater than or less than.

** Exact Placement Of Truck Bolt Holes is determined on the wheel base of each deck

*** Length of titanium strip to be determined by overall length of deck

**** Width of titanium strip to be determined by by the distance between the truck bolt holes and will be approx. 0.25" distance from bolt holes and will sit approx. as drawn on this illustration.

( FIGURE T-7 )

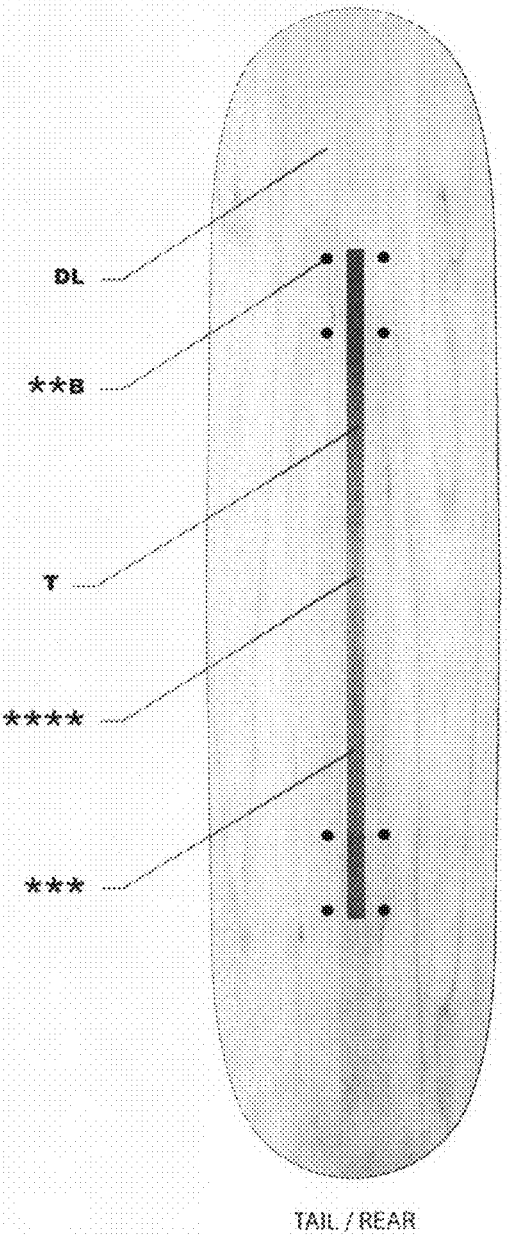

( FIGURE T-8 )

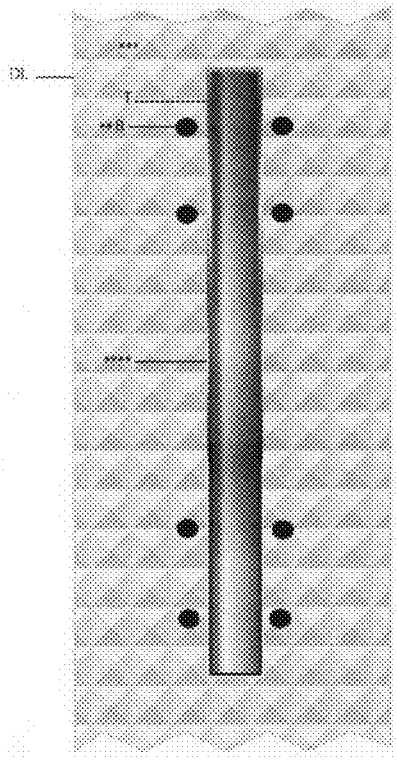

TOP VIEW OF CENTER LAYER SHOWING TITANIUM STRIP PLACEMENT IN COMBINATION WITH ANY SKATEBOARD DECK DESIGN.

DL Skateboard Deck Wood Ply Layer

B Bolt Hole For Truck Mounting.

T Titanium Strip. Thickness approx. 0.020" - 0.028" Greater than or less than.

** Exact Placement Of Truck Bolt Holes is determined on the wheel base of each deck.

*** Length of titanium strip to be determined by width and length and size of trucks and truck hole placement.

**** Width of titanium strip to be determined by by width and size of trucks and truck hole placement.

( FIGURE T-9 )

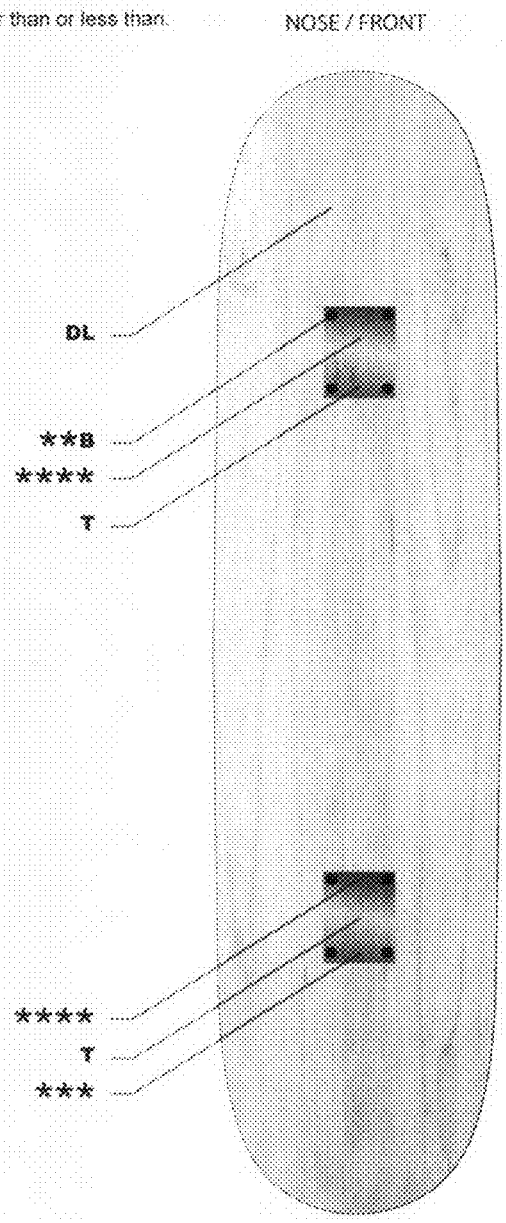

( FIGURE T-10 )

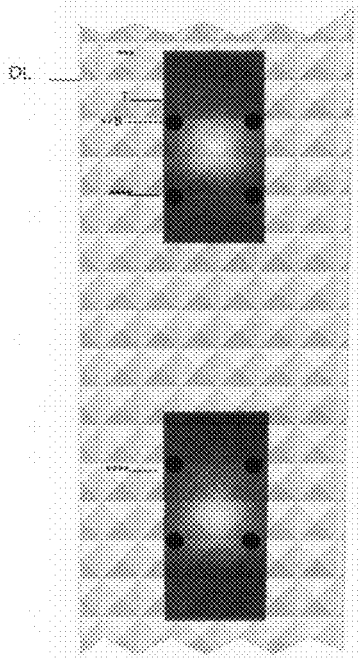

FIGURE T-5

LAMINATED SKATEBOARD

CROSS REFERENCE TO RELATED APPLICATIONS

This application claims the benefit under 35 U.S.C. . . . sctn. 119(e) of U.S. Provisional Patent Application No. 60/456,658, filed Mar. 24, 2003, titled LAMINATED SKATEBOARD, Confirmation number 1914;

STATEMENT REGARDING FEDERALLY SPONSORED RESEARCH OR DEVELOPMENT

"Not Applicable"

THE NAMES TO THE PARTIES TO A JOINT RESEARCH AGREEMENT

"Not Applicable"

INCORPORATION-BY-REFERENCE OF MATERIAL SUBMITTED ON A COMPACT DISK

"Not Applicable"

BACKGROUND OF THE INVENTION (1) Field of the Invention

The field of the invention widely pertains to methods of manufacturing a skateboard deck. The invention contained herein relates more particularly to a method of placing non wood materials, Carbon Fiber/Kevlar Hybrid Woven Material, or Kevlar or Kevlar Hybrid Woven Materials and/or Metallic Alloy/Titanium placed into and placed onto the wood laminates of the skateboard deck during the skateboard deck manufacturing process.

(2) Description of Prior Art

Since the invention of the skateboard, skateboarding has been growing widely and steadily in popularity. Skateboarders have been steadily performing more aggressively. Maneuvers and tricks have been increasing intricately in technical difficulty. Skateboards are anywhere from five laminated layers of wood to as many as nine laminated layers of wood depending on length and width of the skateboard and the use thereof, whether the skateboard deck has been manufactured for street use, ramp use and longboards for just cruising down the sidewalk.

A very important consideration in the manufacturing and development of the skateboard deck has been to make stronger, lighter and more resilient skateboard decks. It is widely known that the skateboard deck has been constructed of layers of wood ply laminations, mostly maple, along with the construction of placing cores of fiberglass, other materials and cores covered with fiberglass. These attempts have been to improve the strength of the skateboard deck. Unfortunately, most all of these so called improvements have only succeeded in making the skateboard deck too heavy and non-responsive for the skateboarder to skate. One such improvement is U.S. Pat. No. 6,182,986, February, 2001, Smith, 280/87.042, as on paper this improvement looks and even sounds like it would work, however to practically apply this method and manufacture a skateboard deck with up to 15 laminated layers of wood and placing Carbon Fiber or Fiberglass as illustrated and explained, creates a very lumpy skateboard and all that has been succeeded has been to dampen the resonance of the wood and to make a skateboard deck that is too thick and too heavy to skate, and without response performance which is due to the dampening of the wood and the overall thickness and weight. The purpose of the improvements contained herein are to enable the skateboarder to continually improve his or her ability in performing maneuvers with a lighter and stronger skateboard deck, without sacrificing the weight and resonance quality of the wood.

Very different types of skateboard deck designs and methods of manufacturing have been played with and developed with an attempt to improve the strength, resiliency, and or the Overall performance of skateboard decks. Some developments in skateboard deck designs have been the length, angle and the shape of the nose (front) and tail (rear) ends of skateboard decks, and the actual shape (concave). These processes are created with an adhesive developed for laminating skateboard decks and under high pressure in the mold which creates the particular shape and concave and are proven successful in adding control for the skateboarder while skating, yet, these have only slightly improved the overall strength and resiliency of the skateboard deck.

There have been different types of ply's and adhesives developed also with an attempt to improve the strength, resiliency and overall durability of skateboard decks. Unfortunately what comes along with these method's is an increase in the overall weight and loss of function ability of the skateboard deck, which in other term's, has affected the feel, sound and performance of the skateboard deck for the skateboarder.

The skateboard decks that are manufactured today are almost always manufactured with hard maple being the preferred laminate wood of choice and are manufactured with trying to maintain a thickness of 0.36" to 0.40" and a weight of 2.25 lbs to a max weight of 2.85 lbs. of the most common skateboard which is 7.75" in width and approx. 32" in length for a street skateboarder so the skateboard deck can be skated and control maintained by the skateboarder.

Skateboard decks are continually exposed to high impact stress. Due to this impact stress, skateboard decks are continually breaking. The integrity of the deck is constantly being breached, and as a result of this, skateboarders are being forced to purchase skateboard decks more often and are being exposed to serious injury due to deck breakage.

Known prior art includes U.S. Pat. No. 3,844,576; U.S. Pat. No. 4,412,687; U.S. Pat. No. 4,523,772; U.S. Pat. No. 5,005,853; U.S. Pat. No. 5,649,717: U.S. Pat. No. 5,759,664; U.S. Pat. No. 5,803,478; U.S. Pat. No. 5,855,389; U.S. Pat. No. 6,182,986, etc.

While these U.S. Patents probably fulfill their respective objectives and requirements, the aforementioned patents do not produce a skateboard deck that is lighter, stronger and more resilient for the skateboarder all at the same time.

In this respect, the skateboard deck in this new construction preparation and placement formula substantially increases the strength, resilience and lightens the overall skateboard deck with the resiliency, response and strength being the focus of the invention.

BRIEF SUMMARY OF THE INVENTION

This is an improved method of constructing a reinforced skateboard deck provided for all uses of a skateboard with the primary focus of the fundamental improvements being first in the performance and the endurance of the skateboard deck. This improved skateboard deck will allow for the skateboarder to more aggressively perform maneuvers without having to constantly consider the ability of the skateboard deck to perform without a serious breach in the integrity of the deck.

One of the primary objectives of this design is to improve the strength, endurance and resiliency of the skateboard deck by adding non wood materials during the laminating process. These non wood materials are Carbon Fiber/Kevlar Bi-Directional Hybrid Woven Material or Kevlar or Kevlar Hybrid Woven Materials and/or Titanium. By installing these non-wood materials precisely according to the design on top and in between the wood ply's increases the overall skateboard deck strength and resiliency and to aid in the reduction and/or eliminate the possibility of the deck snapping.

Another objective of this design is to lighten the overall skateboard deck, thus enabling the skateboarder to more easily perform the intricate maneuvers being attempted each time the skateboarder gets on his or her skateboard. This will also allow the professional and amateur skateboarders to continually create new and more technical maneuvers so as to further progress the sport.

It would be obvious to one of reasonable and ordinary skill in the art of manufacturing skateboard decks that at the time of this invented improvement that the above described process can be applied to any skateboard deck being any amount of laminated wood layers and having any combination in multiples or singularly manufactured using the non-wood materials. The above combinations of this manufacturing process is to illustrate that any combination of the above process can be applied for manufacturing and are not to be confined only to the combinations shown this process. There is no reason to be repetitive. One must keep in mind that the manufacturing of skateboard decks must maintain a thickness and weight so as not to make a skateboard deck too thick, too heavy and that a skateboard deck must maintain the stiff resonance quality of the wood so as to maintain the transfer of the energy required to control and pop a skateboard deck. This has been attained with the above process.

Each and every one of the embodiments mentioned above are intended to be within the scope of the invention herein disclosed. However, despite the foregoing discussion of certain embodiments, only the claims and not this brief description are intended to describe and teach the invention. The summarized embodiments, and other embodiments of the present invention, will become clearly apparent to those who pose the skill and are skilled in the art from the following detailed description of the preferred embodiments having reference to the attached figures with the invention not being limited to any particular embodiment(s) disclosed.

BRIEF DESCRIPTION OF SEVERAL VIEWS OF THE DRAWING (S)

FIG. (1) is a cross section side view of the skateboard deck showing wood laminate layers with two of the wood laminates having non-wood material, either a Carbon Fiber/Kevlar Hybrid Woven Material, or Kevlar Woven Materials adhered to two of the wood laminates.

FIG. (2) shows and exploded view of the entire skateboard deck in FIGS. (1) and (3).

FIG. (3) is cross section view looking down the long axis of the skateboard deck in FIGS. (1) and (2).

FIG. (4) is a cross section side view of a skateboard deck showing wood laminate layers with two of the wood laminates having non-wood material, either a Carbon Fiber/Kevlar Hybrid Woven Material, or Kevlar, Woven Materials adhered to two of the wood laminates and one wood laminate (Center Core) having Titanium in the Core.

FIG. (5) shows an exploded view of the entire skateboard deck in FIGS. (4) and (6).

FIG. (6) is a cross section view looking down the long axis of the skateboard deck in FIGS. (4) and (5).

FIG. (7) is a cross section side view of a skateboard deck showing wood laminate layers with the top wood laminate having non-wood material, either a Carbon Fiber/Kevlar Hybrid Woven Material, or Kevlar Woven Materials adhered to the top laminate layer.

FIG. (8) shows and exploded view of the entire skateboard deck in FIGS. (7) and (9).

FIG. (9) is a cross section view looking down the long axis of the skateboard deck in FIGS. (7) and (8).

FIG. (T-1) shows the top view of a full skateboard laminate with the placement of the Metallic Alloy/Titanium Strip's in this placement configuration. FIG. (T-2) is a top view cross section of FIG. (T-1).

FIG. (T-3) shows the top view of a full skateboard laminate with the placement of the Metallic Alloy/Titanium Strip's in this placement configuration. FIG. (T-4) is a top view cross section of Illustration (T-3)

FIG. (T-5) shows the top view of a full skateboard laminate with the placement of the Metallic Alloy/Titanium Strip in this placement configuration. Illustration (T-6) is a top view cross section of Illustration (T-5).

FIG. (T-7) shows the top view of a full skateboard laminate with the placement of the Metallic Alloy/Titanium Strip in this placement configuration. FIG. (T-8) is a top view cross section of FIG. (T-7).

FIG. (T-9) shows the top view of a full skateboard laminate with the placement of the Metallic Alloy/Titanium Strip's in this placement configuration. FIG. (T-10) is a top view cross section of FIG. (T-9).

DETAILED DESCRIPTION OF THE INVENTION

Referring to the Figure's in this embodiment now beginning with FIGS. (1), (2) and (3). Shown in these Figure's is a standard seven wood laminated layered skateboard deck. This can be created and laminated in any combination thereof, with any combination of laminated layers desired. On the second wood laminate from the top and the very bottom laminate we have installed non-wood material. This non-wood material is not placed on the wood laminate during the laminating process. The non-wood material is adhered to the wood laminate before the normal laminating process begins. What is first determined is where during the laminating process the particular wood laminate with the non-wood material will be inserted, at this time, the type of laminate is chosen, whether it would be core, face or a cross ply. Most all laminate's which have the non-wood material adhered to is first sanded down in thickness with at least greater or less than five to ten thousandths of an inch ((><) 0.005" to 0.010") removed depending on the non-wood material used. This is done to enable the control of the overall thickness and weight of the finished skateboard deck. Now what we will call a "Cartridge" is created. The wood laminate is coated with a two part Epoxy. Then the non-wood material is placed on the wood laminate with the Epoxy, and then another coat of Epoxy is applied. The laminate is then placed between two lengths of Teflon material which are wider and longer than the wood laminate to prevent the Epoxy from adhering to the press. The laminate is then placed in a heated press for the curing process. The pressure is used to push the Epoxy thru the wood laminate to the backside of the laminate to ensure a strong and full bonding of the non-wood material to the wood laminate which is now encased in Epoxy and adhered to the wood laminate. What we now have is a perfectly flat laminate layer the "Cartridge" which we can now laminate.

The overall width and length of the non-wood material is determined by the finished skateboard deck length, shape and width. The non-wood material is cut to come no closer than one half inch, ½" to the inside of the outer edges of the finished skateboard deck, this is to ensure full and proper lamination of the wood laminates to prevent delamination of the edges of the skateboard deck. This process is also to ensure that the wood maintains the resonance quality that must be maintained and prevents the dampening of that resonance quality of the wood by having a layer of Epoxy between the wood laminate and the non-wood material.

Next are FIGS. (3), (4) and (5). Shown in these Figure's is a six laminated layer skateboard deck. This can be created and laminated in any combination thereof, with any combination of laminated layers desired. With the top laminate layer of wood having non-wood material adhered to this laminate along with the bottom wood laminate having non-wood material adhered to this laminate. The process is the same as in FIGS. (1), (2) and (3) except the top laminate non-wood material goes to the edges of the top laminate layer due to the fact that another wood laminate is not being laminated to the top of this laminate.

The center cores in FIGS. (4), (5) and (6) have Metallic Alloy/Titanium installed into this core. (See FIGS. T-1 thru T-10 for optional configuration placement). This center core is sanded down to a thickness of greater than or less than approx. eighteen to thirty four thousandths of an inch ((><) 0.018" to 0.034") to match the thickness of the Metallic Alloy/Titanium which is greater than or less than approx. twenty to twenty eight thousandth's of an inch ((><) 0.020" to 0.028") with the adhesive filling any space between the wood laminates and the Metallic Alloy/Titanium. This sanding is done so when the Metallic Alloy/Titanium is installed into the core and the skateboard is laminated, the Metallic Alloy/Titanium does not register and cannot be seen or felt in the finished skateboard deck. Once the center core is sanded it is then routed out to the precise length and width of the Metallic Alloy/Titanium Strip or Strip's being installed. This center core is then adhered between two laminate cross ply's of wood. Again the exact thickness of the laminate cross ply's of wood is determined by the overall thickness to be obtained for finished skateboard deck. This enable's total control of the overall thickness and weight of the finished skateboard deck now that a Strip or Strip's of Metallic Alloy/Titanium are being installed into the skateboard deck. The creating of this center core is adhered again with an Epoxy. The Epoxy used in the center core is a two part Epoxy. The amount of Catalyst used is determined by ambient temperature, ambient humidity in the air and the curing time desired. One side of the wood laminate cross ply is coated with the Epoxy, then the center core is coated with the Epoxy and the two are placed together, the Metallic Alloy/Titanium Strip or Strip's are then placed into the routed area (s) on the center core, then one side of another wood laminate cross ply is coated with the Epoxy and placed on top of the center core to complete the center core. This core is then placed between two lengths of Teflon which are longer and wider than the wood laminate to prevent the Epoxy from adhering to the press. The core is then placed into a cold press. Extreme caution is used when applying pressure so as not to press out too much of the Epoxy, but enough pressure to ensure a full and complete lamination between the three laminates. Once removed from the press the center core "The Cartridge" is now ready to be laminated during the normal lamination process to make the skateboard deck.

FIGS. (7), (8) and (9). Shown in these Figure's is a five laminated layer skateboard deck. This can be created and laminated in any combination thereof, with any combination of laminated layers desired. Shown is a laminated skateboard deck with non-wood material being adhered to the top laminate layer. This process is the same as in FIG. 4) which shows non-wood material adhered to the top wood laminate.

What I claim is:

1. A reinforced skateboard deck comprising:

a set of multiple stacked wood ply laminate layers;

a metal-reinforced wood ply laminate layer embedded within the set of multiple stacked wood ply laminate layers; and a first layer of non-wood material;

wherein the first layer of non-wood materials is positioned either on top of a first wood ply laminate layer, under the first wood ply laminate layer, or on top of a last wood ply laminate layer.

2. The reinforced skateboard deck of claim 1, wherein the first layer of non-wood material is adhered to an adjacent wood ply laminate layer with epoxy, creating a cartridge layer.

3. The reinforced skateboard deck of claim 2, wherein the first layer of non-wood material comprises Kevlar.

4. The reinforced skateboard deck of claim 2, wherein the first layer of non-wood material comprises Carbon Fiber.

5. The reinforced skateboard deck of claim 1, further comprising:

a plurality of bolt holes for front and rear truck mounting, the bolt holes passing through each of the layers of the reinforced skateboard deck.

6. The reinforced skateboard deck of claim 5, wherein the plurality of bolt holes pass through the metal of the metal-reinforced wood ply laminate layer.

7. The reinforced skateboard deck of claim 6, wherein the metal comprises titanium.

8. The reinforced skateboard deck of claim 1, wherein the metal of the metal-reinforced wood ply laminate layer comprises titanium.

9. The reinforced skateboard deck of claim 1, further comprising:

a second layer of non-wood material;

wherein each of the first and second layers of non-wood material are positioned either on top of a first wood ply laminate layer, under the first wood ply laminate layer, or on top of a last wood ply laminate layer.

10. The reinforced skateboard deck of claim 9, further comprising:

a third layer of non-wood material;

wherein each of the first and second layers of non-wood material are positioned either on top of a first wood ply laminate layer, under the first wood ply laminate layer, or on top of a last wood ply laminate layer.

11. A method of manufacturing a reinforced skateboard deck comprising:

providing a set of wood ply laminate layers, a metal-reinforced wood ply laminate layer, and a first layer of non-wood material;

adhering the first layer of non wood materials within at least one of the wood ply laminate layers, creating a cartridge;

laminating the cartridge, the remaining wood ply laminate layers and the metal reinforced wood ply laminate layers together to form the reinforced skateboard deck;

wherein the resulting structure provides the first layer of non-wood materials is positioned either on top of a first wood ply laminate layer, under the first wood ply laminate layer, or on top of a last wood ply laminate layer.

12. A reinforced skateboard deck comprising:

a set of multiple stacked wood ply laminate layers;

a titanium-reinforced wood ply laminate layer embedded within the set of multiple stacked wood ply laminate layers;

a first layer of non-wood material, the non-wood material comprising at least one of Kevlar or Carbon Fiber; and a plurality of bolt holes for front and rear truck mounting, the bolt holes passing through each of the layers of the reinforced skateboard deck, including passing through the titanium of the titanium-reinforced wood ply laminate layer;

wherein the first layer of non-wood materials is positioned either on top of a first wood ply laminate layer, under the first wood ply laminate layer, or on top of a last wood ply laminate layer.

* * * * *